United States Patent [19]

Blanc et al.

[11] 4,200,993

[45] May 6, 1980

[54] APPARATUS FOR DRYING BOOTS

[76] Inventors: Roger Blanc, Izeaux, (Isere); Serge Jorcin, Corenc Montfleury, (Isere), both of France

[21] Appl. No.: 924,713

[22] Filed: Jul. 14, 1978

[30] Foreign Application Priority Data

Oct. 24, 1977 [FR] France ..... 77 32832

[51] Int. Cl.[2] ..... F26B 9/10

[52] U.S. Cl. ..... 34/104; 34/239; 211/34

[58] Field of Search ..... 34/104, 105, 106, 151, 34/239, 91, 232; 211/34, 35, 36, 37, 38, 62, 63

[56] References Cited

U.S. PATENT DOCUMENTS

| | | | |
|---|---|---|---|
| 508,602 | 11/1893 | Danner | 211/62 |
| 1,074,888 | 10/1913 | McIver | 34/104 |
| 2,977,647 | 4/1961 | Vassiliades et al. | 211/34 |
| 3,078,526 | 2/1963 | Caruso | 34/104 |
| 3,417,482 | 12/1968 | Peet | 34/104 |
| 3,757,429 | 9/1973 | Sumino | 34/239 |
| 3,798,788 | 3/1974 | Kuntz | 34/104 |
| 4,136,464 | 1/1979 | Hay | 34/104 |

*Primary Examiner*—Larry I. Schwartz
*Attorney, Agent, or Firm*—Karl F. Ross

[57] ABSTRACT

An apparatus for drying boots has a hollow housing one of whose upright side walls is formed of a plurality of upper and a plurality of lower pairs of apertures. A blower, a heater, and an ozone generator are provided in this housing for expelling air from these apertures. One aperture of each of the pairs is provided with an upwardly inclined tube having an open upper end. Roots can be racked over these tubes so that air is caused to flow by the apertures of the tubes through the inside of the boots whereas air from the other aperture of the respective pair will flow over the outside of the boot and dry it. In addition at least the upper apertures are associated with a catch trough for drips emanating from the boots on the respective tubes. A larger trough may be provided at the lower apertures for catching drips from the respective boots as well as for catching liquid deflected by the upper troughs against the side of the apparatus.

9 Claims, 3 Drawing Figures

APPARATUS FOR DRYING BOOTS

FIELD OF THE INVENTION

The present invention relates to an apparatus for drying boots.

BACKGROUND OF THE INVENTION

Many types of footwear, in particular those for athletic use, often become wet when used. This is particularly true of ski boots which not only are externally exposed to snow and ice, but are of plastic so that the user's feet often sweat excessively. Thus after use, as at the end of a day's skiing, the user must dry the boots out overnight before they can be used again. This presents little problem for a person with his own equipment, as packing the boots with dry paper or the like and placing them in a warm location so they can dry properly represents a modest maintenance for the often relatively expensive foot gear.

When, however, such footwear, hereinafter referred to generically as boots, is not used by one person, as in a shop which rents such equipment, this maintenance is onerous and indeed often impossible. Thus at the end of the day's skiing the renting agency at the ski slope normally is left with hundreds of pairs of wet boots which must be dried out before they can be rerented early the next day.

The standard solution to this has been simply to set the boots out in a warm location at which is provided a heater and normally even a blower so that overnight sufficient air will be circulated on and around the stacked boots to dry them. In reality this procedure is often ineffective, as the amount of moisture that must be driven off the boots is frequently considerable, and stacking the boots up merely leads to the moisture from one dripping onto the other so that the lowermost boots are never properly dried.

Furthermore in a commercial large-scale operation it is not only essential for economic reasons to reduce the labor envolved in preparing the boots for rerenting, but it is also essential to sanitize the boots as much as possible. Low-grade foot infections and the like can easily be transmitted from one user to another of a pair of rented boots, in paticular when such boots are not completely dried and aired out. In fact the health risk involved in renting footwear often deters many customers, in particular when there is doubt that a properly maintained and sanitized boot can be rented.

OBJECTS OF THE INVENTION

It is therefore an object of the present invention to provide an apparatus which dries boots.

Another object is to provide such an apparatus which in a short time can thoroughly dry and sanitized a multiplicity of boots, using a minimum amount of labor.

Yet another object is to provide such a system which can be combined with a standard storage arrangement so that the boots need merely be put away in their appropriate places, normally determined by size, and then removed from these places once dried for rerenting, without the necessity of passing them through a separate handling stage for drying.

SUMMARY OF THE INVENTION

These objects are attained according to this invention in a boot-drying apparatus with a hollow housing having an upright wall formed with a plurality of upper and a plurality of lower pairs of apertures. A blower and a heater are provided in the housing for expelling heated air from all of these apertures. One of the apertures of each of the pairs is provided with an upwardly inclined tube each having a lower end secured to the housing over one of the apertures of the respective pair and an upper end formed with an outlet hole. Each of these tubes and the respective one aperture it extends from is positioned with respect to the other aperture of the respective pair so that when a boot is hung over the tube heated air from the other aperture of the respective pair passes over the boot. Furthermore according to this invention means in the form of a trough or the like is provided under the upper pairs of the apertures for catching liquid dripping from the boots of the respective tubes and for conducting this liquid away from the boots on the tubes of the underlying lower apertures.

Thus with the apparatus according to the instant invention when turned in the ski boots or the like may simply be racked up on the tubes or pegs of the drying apparatus, which serves not only for drying but for storage of the boots. Air is circulated internally through the boots by means of the outlet holes in the tubes and over each of the boots by means of the other apertures of the respective pairs of apertures. This simultaneous internal and external circulation of air ensures very rapid and effective drying so that in a very short time it is possible to rerent the boots in completely dry condition. Indeed such a device can even be used over lunchtime or the like for drying out the boots of the users before the afternoon skiing.

In accordance with further features of this invention each of these tubes is of polygonal, normally rectangular, section with an upper side constituted by a family of parallel horizontal lines. Thus a boot can be fitted over each of these tubes with its toe directed upwardly and the heel directed downwardly, and will not automatically swing around. This ensures that any water or other liquid inside the boot will automatically be able to run backwardly down the boot and out through the ankle part thereof.

The invention also allows for sanitizing of the boots by providing an ozone generator that mixes ozone with the air that is blown into the boots. Ozone is a highly oxydizing gas which kills most forms of bacteria and simultaneously eliminates most odors. Thus not only are the boots dried, but they are rendered virtually sterile so that the next user need not fear picking up some type of infection from the boots previously used by another.

The catch means according to this invention may be constituted as troughs extending along underneath each of the upper pairs of apertures. Each of these troughs is inclined downwardly back toward the sidewall of the housing of the apparatus and has an outlet or drain hole immediately at this sidewall so that water dripping into the trough is diverted down against the sidewall to run down the side of the boot drying apparatus. At the bottom of the apparatus another larger trough may be provided for catching drips from the lowermost row of boots and for also catching the water that runs down the sidewall of the housing. A drain on this lowermost trough may be connected via a hose to a floor drain or the like so that the boots can dry without making a mess on the floor.

SPECIFIC DESCRIPTION

Figure 1:
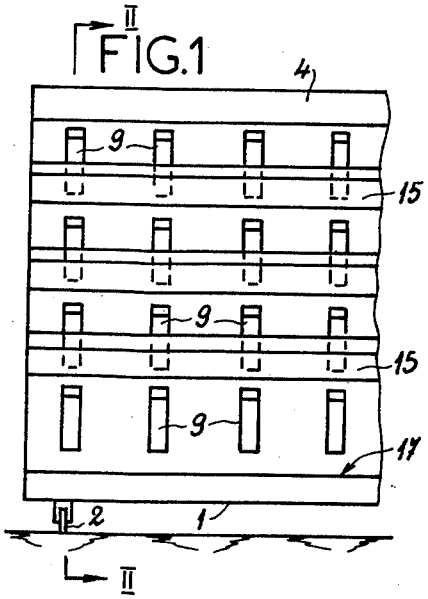
FIG. 1 is a front view of a portion of the apparatus according to the instant invention.
Figure 2:
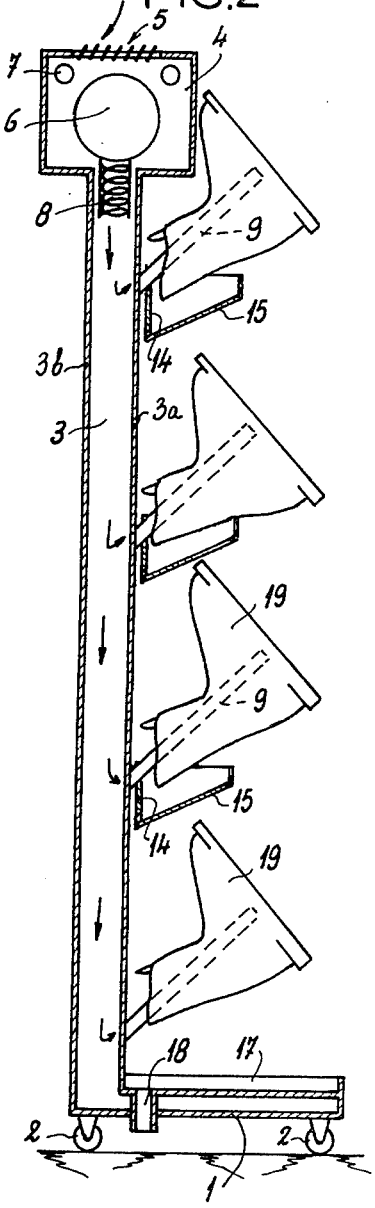
FIG. 2 is a section taken along line II—II of FIG. 1.

As shown in FIGS. 1 and 2 the apparatus according to this invention has a base 1 displaceable along the floor or ground on rollers 2 and provided with an upstanding parallelipipedal box housing 3 extending vertically and having a pair of vertically and horizontally spaced parallel walls 3*a* and 3*b*. At the top of this housing 3 there is provided a hollow enlarged portion 4 extending the full horizontal length thereof and formed at its top with a louvered inlet opening 5. A blower 6 which may be of the axial-input radial-output type is provided in this enlarged portion 4 at the top of the housing 3 so that it can suck in air through the opening 5 and expel it downwardly between the walls 3*a* and 3*b*. Ozone generators 7 of a standard design are provided upstream of the intake of the blower 6 and a resistance-wire heater 8 is provided at the output thereof.

Figure 3:
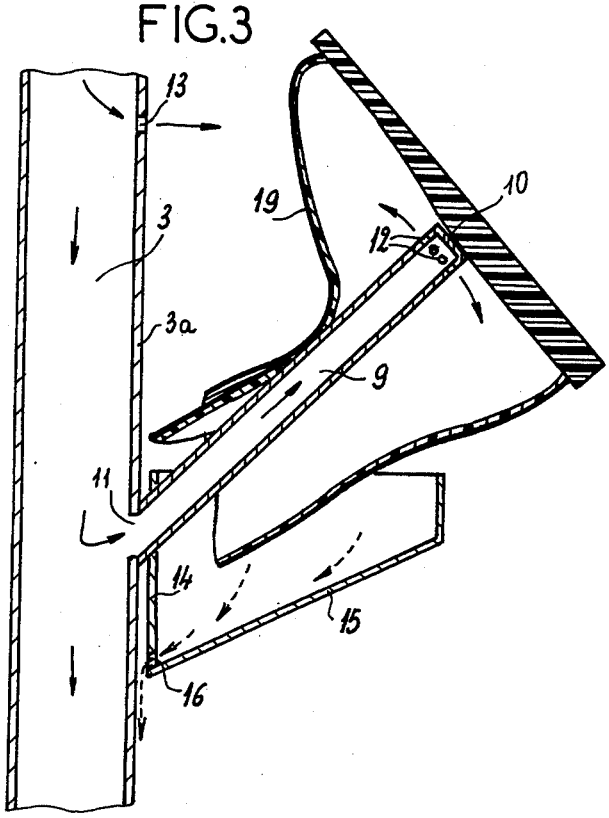
FIG. 3 is a large-scale view of a detail of FIG. 1.

As best seen in FIG. 3 the wall 3*a* of the housing 3 is formed with four horizontal rows of apertures 11 interleaved with four horizontal rows of apertures 13. Extending upwardly from each of the holes or apertures 11 is a respective support tube or peg 9 which is hollow and closed at its upper end 10. Immediately adjacent this upper end 10 the tubes 9 are formed with radially throughgoing openings 12, two in each side of the square-section tubes 9.

Supported on each row of tubes except for the lowermost row is a trough 15 having a backwardly and downwardly sloping bottom wall terminating at a rear wall 14 in a drain opening 16. Below the lowermost row of tubes 9 is provided a trough 17 having a drain 18.

In use ski boots 19 or the like, the term "boots" here referring to any type of footwear to be dried, are placed over the pegs or tubes 9 with their toes up and their heels down. The square section of the tubes 9 prevents the heavier weight of the toes of these boots 19 from rotating them around with their toes downwardly. In addition the tubes 9 are spaced sufficiently far apart that the largest normal size of boots can be placed on any of the pegs 9 without interfering with any of the boots 19. This positions the ankle part of each of the boots 19 directly over the respective trough 15 or 17.

The blower 6, ozone generators 7, and heater 8 are all started up to force heated ozone-enriched air downwardly between the walls 3*a* and 3*b* as shown in solid lines in FIG. 3. This air will exit in part from the holes 13 over the boots 19 so as to dry them externally. In addition it will flow out through the holes 11 along the tubes 9 to exit at the holes 12 inside the boots 19, thereby drying them internally. Any moisture driven off in the boots or snow or ice melted from them will drip down to the trough 15 from the boots of all but the lowermost row. This liquid is then directed by the drain 16 against the sidewall 3*a* whence it can flow down along the sidewall 3*a* to be caught in the wide lower trough 17. The moisture from the lowermost row of boots will simply be caught in the trough 17 which, as mentioned above, is sufficiently wide that any drips from any of the boots, even as they are being positioned over the pegs 9, will be caught. The moisture path is shown by dashed-line arrows in FIG. 3.

It is within the scope of this invention to make the apparatus mirror-symmetrical about a plane parallel to and equispaced between the walls 3*a* and 3*b*, so that pegs 9 would extend from the wall 3*b* and so on.

Thus with the system according to the present invention boots hung over the pegs 9 will quickly and efficiently be dried and sanitized. In fact it has been found that after a very short time the boots are completely dried. What is more, the device is relatively inexpensive so that it is possible to simply shut the blower 6, generators 7, and the heater 8 down once the boots are dried and thereafter use the rack merely to store the boots. This system therefore allows rapid drying of the boots, as is necessary in a rental operation or the like, without making such drying a totally separate operation requiring extra labor.

We claim:

1. An apparatus for drying boots, said apparatus comprising:
   - a hollow housing having an upright side wall formed with a plurality of upper pairs of apertures and a plurality of lower pairs of apertures;
   - means including a blower in said housing for expelling air from said apertures;
   - a plurality of upwardly inclined tubes each having a lower end secured to said housing over one aperture of a respective pair of said apertures and an upper end formed with an outlet hole, each of said tubes and the respective one aperture being positioned with respect to the other aperture of the respective pair so that when a boot is hung over the tube heated air from the other aperture of the respective pair passes over the boot; and
   - means including an upwardly open trough offset from said housing and extending under said upper pairs of apertures for catching liquid dripping from boots over the respective tubes and for conducting said liquid away from boots on the tubes of the underlying lower apertures.

2. The apparatus defined in claim 1 wherein each of said tubes is of polygonal section.

3. The apparatus defined in claim 2 wherein each of said tubes is of substantially rectangular section with an upper side constituted by a family of parallel horizontal lines.

4. The apparatus defined in claim 1, further comprising means for generating ozone and mixing same with said air prior to expelling of same from said apertures.

5. The apparatus defined in claim 1 wherein each of said other apertures is directly above the respective one aperture and slightly above the respective upper end.

6. The apparatus defined in claim 1 wherein each of said tubes has a respective tube axis extending at an angle of between 30° and 60° upwardly from said side wall, each of said tubes being axially closed at the respective upper end and formed thereadjacent with at least one radially opening hole constituting the respective outlet hole.

7. The apparatus defined in claim 1 wherein said housing is a box and is provided with rollers for displacement along the ground.

8. An apparatus for drying boots, said apparatus comprising:
   - a hollow housing having an upright side wall formed with a plurality of upper pairs of apertures and a plurality of lower pairs of apertures;

means including a blower in said housing for expelling air from said apertures;

a plurality of upwardly inclined tubes each having a lower end secured to said housing over one aperture of a respective pair of said apertures and an upper end formed with an outlet hole, each of said tubes and the respective one aperture being positioned with respect to the other aperture of the respective pair so that when a boot is hung over the tube heated air from the other aperture of the respective pair passes over the boot; and means including at least one upwardly open trough under said upper pairs of apertures and having a drain opening adjacent said side wall and oriented to directed liquid caught by said trough against said side wall for catching liquid dripping from boots over the respective tubes and for conducting said liquid away from boots on the tubes of the underlying lower apertures.

9. The apparatus defined in claim 8, further comprising a lower trough underneath said lower apertures and oriented to catch liquid running down said side wall and off boots over the tubes of said lower apertures.

* * * * *